US006668863B2

(12) United States Patent
Maier

(10) Patent No.: US 6,668,863 B2
(45) Date of Patent: Dec. 30, 2003

(54) THROTTLE ELEMENT WITH GAP FILTER

(75) Inventor: Eberhard Maier, Koengen (DE)

(73) Assignee: Robert Bosch GmbH, Stuttgart (DE)

( * ) Notice: Subject to any disclaimer, the term of this patent is extended or adjusted under 35 U.S.C. 154(b) by 13 days.

(21) Appl. No.: 09/964,516

(22) Filed: Sep. 28, 2001

(65) Prior Publication Data

US 2002/0043285 A1 Apr. 18, 2002

(30) Foreign Application Priority Data

Sep. 29, 2000 (DE) ..... 1 00 48 365

(51) Int. Cl.[7] ..... F15D 1/02; F02M 59/44

(52) U.S. Cl. ..... 138/42; 417/295; 417/441; 251/118; 138/41; 123/467; 123/510

(58) Field of Search ..... 137/544; 123/467, 123/510; 138/40, 41, 42; 417/295, 441; 251/118

(56) References Cited

U.S. PATENT DOCUMENTS 3,921,672 A * 11/1975 Arnold ..... 138/42
4,526,151 A * 7/1985 Tateishi et al. ..... 123/468
5,160,088 A * 11/1992 Weiss et al. ..... 239/88
5,360,164 A * 11/1994 Pape et al. ..... 239/88
5,638,793 A * 6/1997 Rapp et al. ..... 123/500
5,937,909 A * 8/1999 Clauss et al. ..... 138/43
6,216,583 B1 * 4/2001 Klinger et al. ..... 92/129
6,415,768 B1 * 7/2002 Usui ..... 123/468

FOREIGN PATENT DOCUMENTS

EP 0 874 152 A2 * 10/1998

* cited by examiner

*Primary Examiner*—John Rivell
*Assistant Examiner*—Ramesh Krishnamurthy
(74) *Attorney, Agent, or Firm*—Ronald E. Greigg

(57) ABSTRACT

A throttle element with a gap filter for use in a fuel pump is proposed, which is press-fitted into a conduit in the housing of an injection pump. By means of the press fitting, a good sealing action and at the same time low-cost production and mounting are attained. The throttle element can furthermore be designed economically and compactly.

15 Claims, 1 Drawing Sheet

THROTTLE ELEMENT WITH GAP FILTER

BACKGROUND OF THE INVENTION

1. Field of the Invention

The invention relates to a throttle element for incorporation into a fuel-carrying conduit, and to an injection pump embodying such a throttle element.

2. Description of the Prior Art

A throttle element embodied as an insert, for incorporation into a fuel-carrying conduit with a throttle and a filter collar, which is secured in the conduit with a thread, is known.

Because of the thread and because of the necessity of being able to exert a tightening torque on the throttle element, this throttle element is relatively large in structure. Furthermore, producing the thread in the conduit and in the throttle element and the production of a screw head, such as a hexagonal socket head, entails cost.

OBJECT AND SUMMARY OF THE INVENTION

The object of the invention is furnish a throttle element with a gap filter that can be produced economically, is compact in structure, is favorable from a production standpoint, and can be mounted simply and reliably.

According to the invention, this object is attained by a throttle element for incorporation into a fuel-carrying conduit, having a throttle by which a fluid flow flowing through the throttle element can be limited, the throttle element being embodied as an insert and having a sealing portion that cooperates with the conduit, and a passage having a throttle is provided between the two sides of the sealing portion, and a filter collar that with the conduit forms an annular gap is present on the throttle element, and the throttle element is press-fitted into the conduit.

By means of the throttle element of the invention, the incorporation into the fuel-carrying conduit is facilitated; neither a female thread in the conduit nor a male thread in the throttle element has to be cut, which simplifies production. Furthermore, the throttle element can be made shorter, which widens its utility and further reduces the costs for the conduit, which is now shorter. These advantages are especially significant because these involve large-scale mass-produced items in which even small savings per item add up to large amounts.

Furthermore, because of the press fit between the throttle element and the conduit, precise positioning of the throttle element in the conduit is attained and thus the tightness is improved. In a version involving screwing with a thread, the location of the throttle element in the conduit cannot be replicated with the same accuracy.

In a further feature of the invention, the sealing portion is embodied as a cylindrical collar or a conical collar, making simple production with optimal sealing action attainable. In the case of a conical collar, the production tolerance can be increased somewhat without any sacrifice in terms of tightness.

In a further feature of the invention, the sealing portion is embodied as a truncated cone, which cooperates with a corresponding sealing seat in the conduit, so that the sealing action of the sealing portion is virtually independent of the diameter of the sealing portion.

In further variants of the invention, it is provided that the throttle element has a centering collar with a fluid passage, and/or that the centering collar is chamfered, and that the fluid passage is embodied as a flat face, so that tilting of the throttle element upon mounting is precluded.

In a further feature of the invention, the throttle element has a sleeve, and the sleeve is upset in the pressing process, so that the throttle element can be secured in the conduit in prestressed fashion, and thus even over a long service life, the sealing action and the function of the throttle element are assured.

The object stated above is also attained by an injection pump, having a low-pressure region and a high-pressure region, having a conduit for removing leaking oil from the low-pressure region, and having a throttle element according to the invention so that the injection pump has a leaking oil removal that has the advantages of the invention. In injection pumps, the pumping quantity of the high-pressure region is regulated by an intake throttle restriction. The metering valves employed have a certain leakage in the closed state, and in the overrunning mode of the engine this leads to a gradual increase in pressure on the intake side of the high-pressure fuel pump and thus causes it to begin pumping. To prevent this, between the intake side of the high-pressure fuel pump, corresponding to the low-pressure region of the injection pump, and the pressureless fuel return, a throttle, the so-called zero-feed throttle, is provided, by way of which the leakage from the low-pressure region is removed. By the use of a throttle according to the invention as a zero-feed throttle, the aforementioned advantages can be achieved.

In further features of the invention, the conduit has a graduated diameter, and the transition between the diameters is embodied as a sealing seat, or a closure body is press-fitted into the conduit, and the closure body exerts a pressing force on the sleeve of the throttle element. In these versions, reliable sealing between the throttle element and the conduit is assured, regardless of the production tolerances of the throttle element. Because the closure body exerts a pressing force on the sleeve of the throttle element, an adequately high pressure per unit of surface area between the sealing faces of the throttle element and the conduit is assured under all operating conditions.

BRIEF DESCRIPTION OF THE DRAWINGS

The invention will be better understood and further objects and advantages thereof will become more apparent from the ensuing detailed description of preferred embodiments taken in conjunction with the drawings, in which.

DESCRIPTION OF THE PREFERRED EMBODIMENTS

Figure 1:
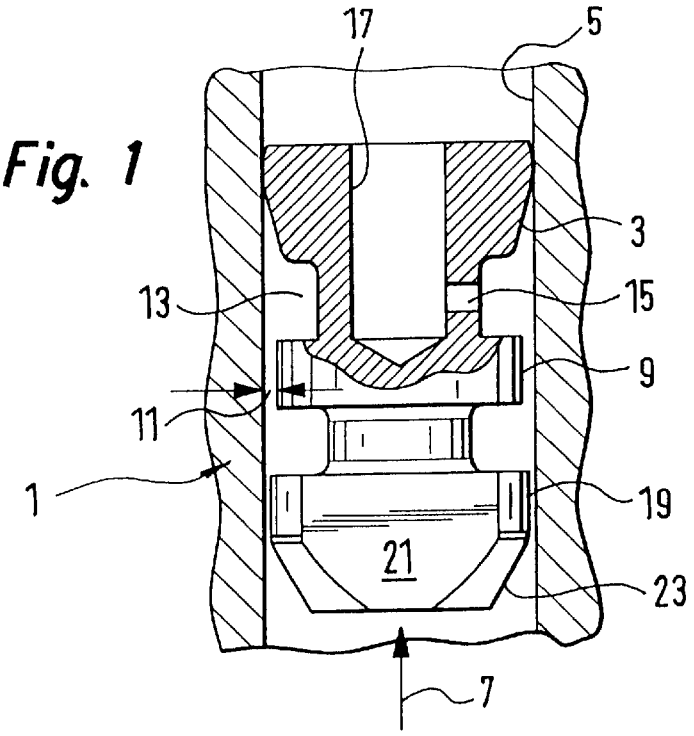
FIG. 1 is a fragmentary sectional view showing a first exemplary embodiment of a throttle element of the invention.

In FIG. 1, a first exemplary embodiment of a throttle element 1 of the invention is shown, partly in section. The throttle element 1 can be divided longitudinally into three portions. A sealing portion 3, which is embodied as a conical collar, divides a conduit 5 into two portions. The flow direction of the fuel, not shown, that flows in the conduit 5 is indicated by an arrow 7. Upstream of the sealing portion 3, there is a filter collar 9, which is dimensioned such that an annular gap 11 is formed between the wall of the conduit 5 and the filter collar 9. In an annular groove 13 between the filter collar 9 and the sealing portion 3, there is a throttle bore 15, which together with a longitudinal bore 17 makes a passage for the fuel through the sealing portion 3. The diameter of the throttle bore 15 is larger than the annular gap 11, so that contaminants in the fuel, which are not trapped in the annular gap 11, cannot plug up the throttle bore 15. Because of the great length of the annular gap 11, the annular gap 11 does not significantly throttle the fluid flow in the conduit 5. For the most part by far, this function is taken over by the throttle bore 15.

Upstream of the filter collar 9, there is a centering collar 19, which has a fluid passage 21 embodied as a flat face. The centering collar 19 furthermore has a chamfer 23, which makes it easier to position the throttle element against it as it is being press-fitted into the conduit 5. The diameter of the centering collar 19 is greater than that of the filter collar 9 and somewhat smaller than the largest diameter of the sealing portion 3, so that on the one hand optimal sealing action is attained and the throttle element 1 is effectively protected against tilting, and on the other, it is assured that the filter collar 9 cannot be damaged upon mounting of the throttle element 1 in the conduit In FIG. 2, a second exemplary embodiment of a throttle element 1 of the invention is shown. In this exemplary embodiment, the conduit 5 is embodied as a stepped bore. The sealing portion 3 of the throttle element 1 is embodied as a frustoconical sealing face, which cooperates with a corresponding sealing seat in the housing of the injection pump. The sealing seat in the housing of the injection pump is provided at a change in diameter of the conduit 5. Advantageously, the cone angle of the sealing portion 3 is somewhat greater than that of the sealing seat in the injection pump housing, resulting in a circular sealing line between the throttle element 1 and the sealing seat. This enhances the tightness. The fuel can flow around the sealing portion 3 through a passage. The passage comprises a throttle bore 15, a longitudinal bore 17, and a transverse bore 25.

Figure 2:
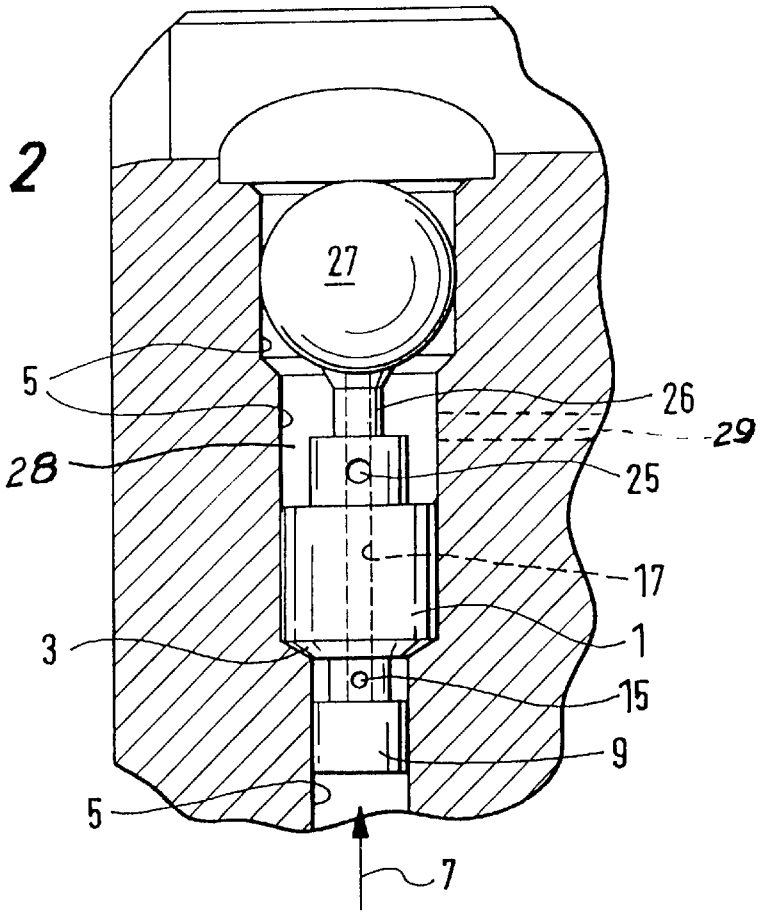
FIG. 2 shows a second exemplary embodiment of a throttle element of the invention.

Upstream of the throttle bore 15, a filter collar 9 is provided, which in the same way as in the first exemplary embodiment, together with the conduit 5, forms an annular gap, not visible in FIG. 2. In this embodiment again, the annular gap is smaller than the diameter of the throttle bore 15, which effectively prevents the throttle bore from becoming plugged up.

To assure a steady pressure of the throttle element 1 against the sealing seat, a sleeve 26 is disposed on the throttle element 1 in a chamber 28 between the transverse bore 25 and a ball 27 press-fitted into the conduit 5 and pressing against the sleeve 26. Fuel flows from chamber 28, as through an outlet 29 in conduit 5, or around ball 27 through passages formed, for example, by flat surfaces, or grooves (not shown) on the surface of ball 27.

To obtain constant pressing forces, it is advantageous if, as the ball 27 is being press-fitted onto the throttle element 1 in the conduit 5, the course of the requisite press-fitting force over the press-fitting travel is detected. Not until the throttle element 1 is seated on the sealing seat and the sleeve 26 has been deformed at least elastically can the press-fitting process be ended. The ball 27, together with the corresponding part of the conduit 5, forms a press fit, so that the throttle element 1 is permanently prestressed in the axial direction.

The foregoing relates to preferred exemplary embodiments of the invention, it being understood that other variants and embodiments thereof are possible within the spirit and scope of the invention, the latter being defined by the appended claims.

I claim:

1. In a throttle element for incorporation into a fuel-carrying conduit (5), having a throttle (15) by which a fluid flow flowing through the throttle element (1) can be limited, the throttle element (1) being embodied as an insert and having a sealing portion (3) that cooperates with the conduit (5), and a passage in fluid communication with the throttle (15) is provided within the sealing portion (3), and a filter collar (9) that with the conduit (5) forms an annular gap (11) is present on the throttle element (1), the improvement wherein said throttle element (1) is press-fitted into the conduit (5), wherein said sealing portion (3) is embodied as a truncated cone, which cooperates with a corresponding sealing seat in the conduit (5).

2. The throttle element (1) according to claim 1, wherein said throttle element (1) has a centering collar (19) with a fluid passage (21).

3. In a throttle element for incorporation into a fuel-carrying conduit (5), having a throttle (15) by which a fluid flow flowing through the throttle element (1) can be limited, the throttle element (1) being embodied as an insert and having a sealing portion (3) that cooperates with the conduit (5), and a passage in fluid communication with the throttle (15) is provided within the sealing portion (3), and a filter collar (9) that with the conduit (5) forms an annular gap (11) is present on the throttle element (1), the improvement wherein said throttle element (1) is press-fitted into the conduit (5), wherein said throttle element (1) has a centering collar (19) with a fluid passage (21).

4. The throttle element (1) according to claim 3, wherein said centering collar (19) is chamfered, and that the fluid passage (21) is embodied as a flat face.

5. The throttle element (1) according to claim 3, wherein said throttle element (1) has a sleeve (26), and that the sleeve (26) is upset in the pressing process.

6. The throttle element (1) according to claim 4, wherein said throttle element (1) has a sleeve (26), and that the sleeve (26) is upset in the pressing process.

7. An injection pump, having a low-pressure region and a high-pressure region, having a conduit (5) for removing leaking oil from the low-pressure region, and having a throttle element with a gap filter in the conduit (5), characterized in that the throttle element is a throttle element (1) according to claim 3.

8. An injection pump, having a low-pressure region and a high-pressure region, having a conduit (5) for removing leaking oil from the low-pressure region, and having a throttle element with a gap filter in the conduit (5), characterized in that the throttle element is a throttle element (1) according to claim 4.

9. The injection pump according to claim 7, wherein said conduit (5) has a graduated diameter, and that the transition between the diameters is embodied as a sealing seat.

10. The injection pump according to claim 8, wherein said conduit (5) has a graduated diameter, and that the transition between the diameters is embodied as a sealing seat.

11. In a throttle element for incorporation into a fuel-carrying conduit (5), having a throttle (15) by which a fluid flow flowing through the throttle element (1) can be limited, the throttle element (1) being embodied as an insert and having a sealing portion (3) that cooperates with the conduit (5), and a passage in fluid communication with the throttle (15) is provided within the sealing portion (3), and a filter collar (9) that with the conduit (5) forms an annular gap (11) is present on the throttle element (1), the improvement wherein said throttle element (1) is press-fitted into the conduit (5), wherein said throttle element (1) has a sleeve (26), and that the sleeve (26) is upset in the pressing process.

12. An injection pump, having a low-pressure region and a high-pressure region, having a conduit (5) for removing leaking oil from the low-pressure region, and having a throttle element with a gap filter in the conduit (5), said throttle element (1) having a throttle (15) by which a fluid flow flowing through the throttle element (1) can be limited, the throttle element (1) being embodied as an insert and having a sealing portion (3) that cooperates with the conduit (5), and a passage in fluid communication with the throttle (15) is provided within the sealing portion (3), and a filter collar (9) that with the conduit (5) forms an annular gap (11) is present on the throttle element (1), the improvement wherein said throttle element (1) is press-fitted into the conduit (5).

13. The injection pump according to claim 12, wherein said conduit (5) has a graduated diameter, and that the transition between the diameters is embodied as a sealing seat.

14. The injection pump according to claim 12, further comprising a closure body (27) is press-fitted into the conduit (5), and that the closure body (27) exerts a pressing force on the sleeve (26) of the throttle element (1).

15. The injection pump according to claim 13, further comprising a closure body (27) is press-fitted into the conduit (5), and that the closure body (27) exerts a pressing force on the sleeve (26) of the throttle element (1).

* * * * *